United States Patent [19]

Schaefer

[11] Patent Number: 4,543,557

[45] Date of Patent: Sep. 24, 1985

[54] PANEL MOUNTABLE FUSE HOLDER

[75] Inventor: Rudolf K. Schaefer, Des Plaines, Ill.

[73] Assignee: Littelfuse, Inc., Des Plaines, Ill.

[21] Appl. No.: 556,630

[22] Filed: Nov. 30, 1983

[51] Int. Cl.[4] ..... H01R 13/62; H01R 3/00

[52] U.S. Cl. ..... 337/196; 337/212; 337/213; 339/91 R; 339/147 R

[58] Field of Search ..... 337/196, 212, 213; 339/147 R, 147 P, 91 R

[56] References Cited

U.S. PATENT DOCUMENTS

| | | | |
|---|---|---|---|
| 1,864,283 | 6/1932 | Steinmayer . | |
| 3,409,858 | 11/1968 | Krehbiel | 339/91 R |
| 3,659,252 | 4/1972 | Brown | 339/147 R |
| 3,874,763 | 4/1975 | Hoover | 339/91 R |
| 3,976,967 | 8/1976 | Magherini | 339/147 P |
| 4,126,368 | 11/1978 | Godfrey et al. | 339/258 F |
| 4,178,061 | 12/1979 | Ahroni | 339/147 P |

FOREIGN PATENT DOCUMENTS

| | | | |
|---|---|---|---|
| 2082851 | 3/1982 | United Kingdom | 339/147 P |
| 2098008 | 11/1982 | United Kingdom | 339/147 P |

*Primary Examiner*—Gil Weidenfeld
*Assistant Examiner*—Gary F. Paumen
*Attorney, Agent, or Firm*—Russell E. Hattis

[57] ABSTRACT

A fuse holder includes a fuse carrier insertable into a passageway in a fuse holder body mountable in a vertical panel opening. The fuse carrier supports an active fuse in a U-shaped recess loosely holding the fuse in a horizontal position extending parallel to the panel. The fuse holder body includes a shoulder adjacent the front end thereof for preventing the complete withdrawal of the fuse carrier from said fuse holder body when the fuse carrier is pulled to the front of the body. The fuse carrier has pivot pins for pivotally engaging this shoulder so that the carrier drops into a position where it hangs downwardly from said fuse holder body where a fuse releasably held on the carrier is exposed for removal. The fuse holder body and fuse carrier have releasable interlocking parts which become interlocked when the fuse carrier has been pushed into a fully retracted position within the fuse holder body where the fuse terminals engage with terminal clips. The fuse carrier has a gripping handle which when depressed releases the interlocking parts to permit partial withdrawal of the fuse carrier from the fuse holder body. A spare fuse-receiving cavity is located behind the handle to support the spare fuse oriented parallel to the active fuse.

20 Claims, 7 Drawing Figures

PANEL MOUNTABLE FUSE HOLDER

TECHNICAL FIELD OF INVENTION

This invention relates to an improvement in panel mountable fuse holders of the box type. Such a fuse holder generally comprises a box-like body mountable in a panel opening and having a fuse-receiving passageway opening onto the front thereof for receiving a conventional cylindrical fuse held in a carrier so as to be parallel to the front opening of the fuse-receiving passageway. The carrier is inserted within this passageway and pushed to the rear thereof where the end caps of the cylindrical fuse engage a pair of clip-terminals. The present invention deals with a unique design of this carrier and its relationship to the fuse holder body.

BACKGROUND OF THE INVENTION

Panel mountable fuse holders have been heretofore constructed of two different basic configurations. In the more old and conventional form, the fuse holder has a body mountable in a panel opening, the body having a fuse-receiving passageway adapted to receive a cylindrical fuse projecting rearwardly from a fuse carrier. The fuse thus extends transversely of the panel in which the fuse holder is mounted. The carrier includes a terminal strip which connects with the fuse end cap of the fuse and is exposed on the side of the carrier to make connection with a terminal within the fuse holder body, as does the rear end cap thereof. The fuse carrier with the cylindrical fuse projecting rearwardly therefrom is inserted within the fuse-receiving passageway of the fuse holder body and is releasably locked therein by a bayonet-type joint, threaded connection or some other interlocking means. Since the terminal strip of the fuse carrier can be inadvertently grasped, a shock hazard exists if the strip touches the fuse holder body terminal as the carrier is being inserted into the fuse holder body. Various constructions were devised to avoid this shock hazard. This type of fuse holder generally requires a large number of parts and requires a more complex assembly operation than the other type of fuse holder now to be described. U.S. Pat. No. 3,659,252, granted Apr. 25, 1972 discloses this first type of fuse holder.

The other type of fuse holder referred to is a box type fuse, as exemplified by the fuse holder construction shown in U.S. Pat. No. 4,126,368, granted Nov. 21, 1978. This fuse holder has a box-like fuse holder body mountable in an a panel opening and includes at the rear of a fuse-receiving passageway thereof a pair of horizontally spaced terminal clips positioned parallel to the panel. The fuse carrier for this fuse holder has a generally C-shaped fuse carrying clip at the rear end thereof which tightly receives a cylindrical fuse oriented parallel to the panel. The fuse carrying clip is located at the juncture of a pair of compressible arms which when compressed allows the fuse carrier to be inserted within the fuse-receiving passageway of the fuse holder body, and when released becomes locked within the fuse holder body in a position where the fuse end caps are nestled within the terminal clips of the fuse holder body. The fuse carrier is removed from the fuse holder body by compressing these arms and withdrawing the carrier from the fuse holder body.

The present invention is an improvement over the type of fuse holder disclosed in this U.S. Pat. No. 4,126,368, among various reasons, in that the carrier is permanently connected to the fuse holder body and related thereto in a manner to be more conveniently manipulated during insertion and partial removal of the carrier from the fuse holder body. Also, it is designed to carry a spare fuse, and is constructed so as to ensure a most effective electrical contact between the fuse end caps and the fuse terminal clips of the fuse holder body, despite variations in the relative positions of the fuse end caps and the fuse holder clips caused by tolerance limitations.

SUMMARY OF THE INVENTION

In accordance with one of the features of the invention, the fuse carrier is insertable into and removable from the fuse holder body without the need to squeeze and release a pair of compressible arms. Rather, the fuse carrier is inserted fully within the fuse holder body by merely pushing it into a fuse carrier-receiving opening in the front of the fuse holder body which opens onto a fuse-receiving passageway and fuse carrier guideway. Removal of the carrier therefrom is accomplished by merely pressing the handle portion down and then pulling the same into a forward position where it pivots down to hang from the fuse holder body where the fuse is exposed for easy replacement. While the fuse holder of said U.S. Pat. No. 3,659,252 releases the carrier of the completely different type of fuse holder involved, by a downward force on the fuse carrier, the carrier completely separates from the fuse holder body and otherwise interfits with the fuse holder body in a different manner than the carrier of the most preferred form of the invention. Thus, the fuse carrier of the fuse holder of the invention cannot be misplaced and the user has both hands available for replacing a blown fuse on the carrier. The carrier is returned into its operative position after fuse replacement by merely lifting the fuse carrier and then pressing the same back into the fuse holder body.

In accordance with another feature of the invention, the fuse carrier is provided with a uniquely designed fuse-holding recess so that the fuse is loosely retained therein. Thus, when the fuse carrier is inserted within the fuse holder body the fuse can move with respect to the carrier to a sufficient degree that the end caps of the fuse are in a position to make the best electrical contact with the terminal clips in the fuse holder body, to minimize the contact resistance therebetween. To this end, in accordance with another specific feature of the invention, the carrier presents a U-shaped fuse body-receiving recess in the upper surface thereof. The rear defining wall of this recess terminates in a rearwardly extending upper resilient finger portion which flexes to enable the partially closed mouth of the recess to receive the normally larger diameter fuse, which snaps into a loosely held position within the recess. The fuse is thus allowed to float within the fuse-receiving recess of the carrier so as to align itself properly with the terminal clips. The rear defining wall of this recess joins at the bottom thereof a rearwardly extending rigid projecting portion which terminates in a pair of laterally projecting pivot pins for enabling the carrier to pivot into a downward position where it hangs from the fuse holder body when it is pulled fully to the forward end of the fuse holder body. The pivot pins are held within the fuse holder by a shoulder preferably forced by the enlarged head portion of a resilient pivoted locking tongue which aids also in releasably locking the fuse carrier in its fully retracted position within the fuse holder body.

In accordance with a specific feature of the invention, this locking tongue extends upwardly from the bottom of the fuse holder body and urges the carrier upwardly and forwardly where it is interlocked with a shoulder extending downwardly from the top of the fuse holder body. When viewed in its finally horizontally oriented position within the fuse holder body the fuse carrier has a preferably horizontally elongated rectangular gripping handle having a generally vertical front face terminating in rearwardly extending top and bottom faces. The upper face of this handle forms a finger depressing surface releasing the carrier from locking engagement with the fuse holder body when the carrier is depressed against the restraining force of the locking tongue. The depressed carrier is then pulled forwardly into a fully extended position, where it pivots down to hang from the fuse holder body.

In accordance with another feature of the invention, the carrier is provided at a point immediately behind the vertical front wall of the handle thereof with a cylindrical open-ended cavity into which a spare fuse can be longitudinally inserted. The fuse carrier has a pair of horizontally extending spring arms which fit between the end caps of the fuse releasably to retain the fuse in place within this cavity.

The above described and other features of the invention will become apparent upon making reference to the specification to follow, the drawings and the claims.

DESCRIPTION OF EXEMPLARY EMBODIMENT OF THE INVENTION SHOWN IN THE DRAWINGS

Figure 3:
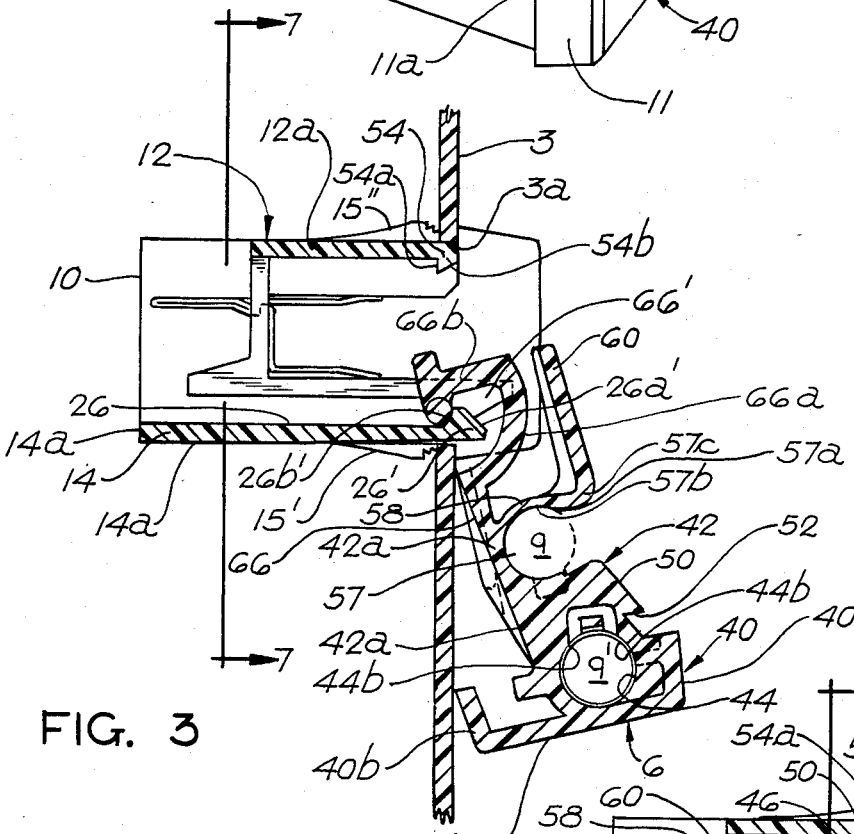
FIG. 3 shows the same vertical sectional view as shown in FIG. 2 when the carrier portion of the fuse holder has been pulled into its forwardmost position where it hangs downwardly from the fuse holder body for convenient replacement of a blown fuse.

The most preferred form of the fuse holder as shown in the drawings comprises four pieces which are assembled by snap-action interfitting of the parts. Thus, the fuse holder 2 comprises a main synthetic plastic molded box-like body 4 adapted to be pushed into a stable mounted position through the panel opening 3*a* in a vertical panel 3 (FIGS. 2 and 3), a synthetic plastic molded fuse carrier 6 which snap-fits within the fuse holder body 4 and a pair of terminal clips 8—8 which snap-fit within the fuse holder body 4 in a manner to be described. The fuse holder body 4 has a carrier-receiving opening in the front thereof which receives the fuse carrier and communicates with a fuse-receiving passageway and fuse carrier guideways to be described. The fuse carrier 6 carries an active fuse 9 in a floating self-aligning manner to be described and a spare fuse 9'. The fuse carrier 6 is movable into a retracted position within the fuse holder body 4 by simply pushing the same into a rearwardmost position within the body where it snaps into a stable, releasable locked position. A self aligning, floating support of the fuse 9 on the carrier makes an optimum low resistance connection with the fuse clips 8—8. To change the or examine the fuse 9, the exposed upper portion of the front portion of the fuse carrier is depressed to release the locking snap-fitting relationship of the fuse carrier within the body 4, and then pulled to the front of the fuse holder body 4. Upon release thereof, it pivots and drops down to a position where it hangs from the body 4 as shown in FIG. 3. The fuse 9 is then fully exposed to be conveniently removed and replaced by the spare fuse 9'.

While the fuse holder body 4, the fuse carrier 6, and terminal clips 8—8 can have a variety of different constructions and still incorporate the broad aspects of the invention, these parts are most preferably constructed in the manner now to be described.

Figure 4:
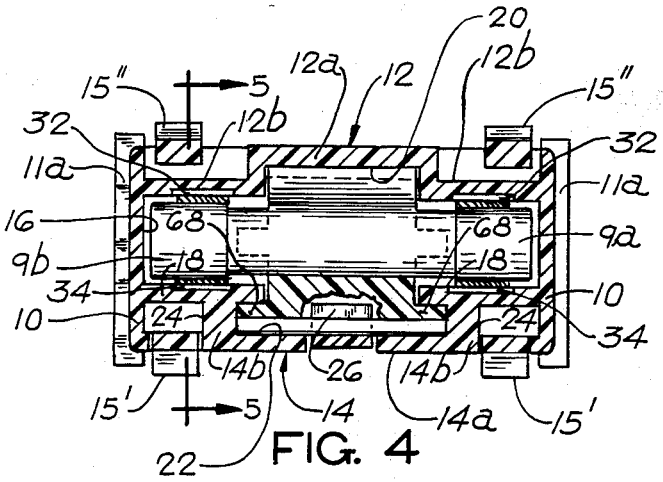
FIG. 4 is a vertical sectional view through the fuse holder in FIG. 2, taken along section line 4—4 therein.

The fuse holder body 4 has a pair of vertical side walls 10—10 interconnected by a horizontal top wall 12 only in the mid-regions thereof and by a horizontal rear bottom wall portion 14*a* (FIG. 4). A pair of laterally spaced guideway-forming horizontal wall portions 14*b*—14*b* (FIG. 4) and a locking tongue 26 extend forwardly from the rear bottom wall portion 14*a* (see FIGS. 2 and 4). A pair of resilient mounting arms 15'—15' project forwardly from the rear bottom wall portion 14*a* between the wall portions 14*b*—14*b* and the side walls 10—10. The mounting arms 15'—15' have inclined and stepped head portions 15*a'*—15*a'* which snap behind the rear face of the vertical mounting panel 3 to hold the mounting body in place. A similar pair of mounting arms 15''—15'' project forwardly from the rear of the side portions of the top wall 12 and have inclined and stepped head portions 15*a''* and 15*a''* which snap behind the rear face of the panel opening 3.

The side walls 10—10 terminate at the front thereof in outwardly projecting head portions 11—11 which form rearwardly facing shoulders 11*a*—11*a* which engage the front face of the panel 3 to cooperate with the mounting arms 15'—15' and 15''—15'' to hold the fuse holder body 4 securely in place within the panel opening 3*a* when the body is pressed rearwardly through the opening 3*a* from the front of the panel 3.

Figure 7:
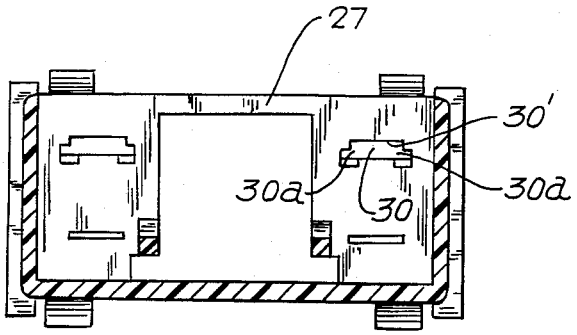
FIG. 7 is a vertical sectional view through the fuse holder shown in FIG. 3, taken along section line 7—7 therein with the terminal clips removed, and showing the configuration of the terminal clip blade-receiving apertures in the vertical rear wall of the fuse holder body.
Figure 5:
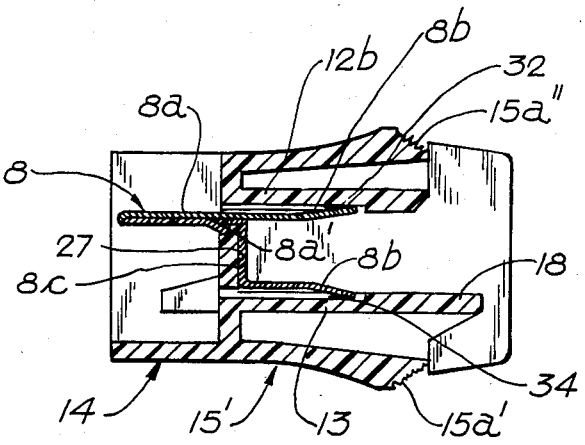
FIG. 5 is a vertical sectional view through the fuse holder shown in FIG. 4, taken along section line 5—5 therein, and shows, among other things, the manner in which the terminal clips are mounted within the fuse holder body.
Figure 6:
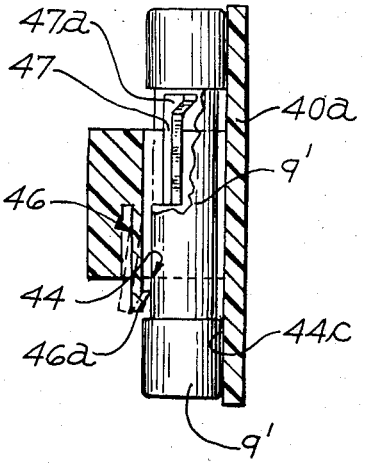
FIG. 6 is a sectional view through the fuse carrier of the fuse holder of the invention showing the manner in which a spare fuse is retained in place on the carrier.

The horizontal top wall 12 has a raised center portion 12*a* joining lower offset side portions 12*b*—12*b* (FIG. 4) to define an upper body carrier guideway 20 which opens onto the front of the fuse holder body and guides the carrier 6 into and out of the fuse holder body in a manner to be described. The fuse holder body 4 also has intermediate horizontal walls 18—18 projecting inwardly from the side walls 10—10 and connecting with the bottom wall portion 14*b*—14*b* through vertical connecting walls 24—24 to define a lower body carrier guideway 22 which opens onto the front of the fuse holder body and guides the carrier 6 for movement in a manner to be described. The space defined between the top horizontal wall portion 12*b*—12*b*, the side walls 10—10 and the intermediate horizontal walls 18—18 define therebetween a fuse-receiving passageway 16 which opens onto the front of the fuse holder body 4 and provides clearance for the passage of the fuse 9 when the carrier 6 is moved into the fuse holder body. The rear of the passageway 16 is defined by a vertical wall 27 spaced substantially forwardly from the rear edges of the side walls 10—10 to define a rear cavity within the body to receive a female connector (not shown) which mates with the projecting terminal blade portions 8*a*—8*a* (FIG. 5) of the terminal clips 8—8. The vertical wall 27 has a pair of generally T-shaped openings 30—30 (FIG. 7) having narrow end portions 30*a*—30*a* which tightly receives terminal barbs 8*a*'—8*a*' of the terminal blades 8*a*—8*a*. These barbs 8*a*'—8*a*' snap fit in pockets on the back surface of wall 27 when the terminal clips are pushed into the rear of the fuse-receiving passageway 16 from the front of this passageway. The terminal clips 8–8 have vertically spaced horizontal clip-forming arms 8*b*—8*b* which can extend into recesses 32–34 formed respectively in the confronting faces of the top and bottom horizontal wall portions 12*b*—12*b* and 18—18 (FIGS. 4 and 5). The clip-forming arms 8*b*—8*b* are interconnected by connecting webs 27 which bear against the rear face of the vertical wall 27 of the fuse holder body. When the carrier 6 is pressed fully into the rear of the fuse holder body 4, the end caps 9*a*–9*b* of the cylindrical fuse 9 are snugly held between the clip-forming arms 8*b*—8*b* of the terminal clips.

Figure 2:
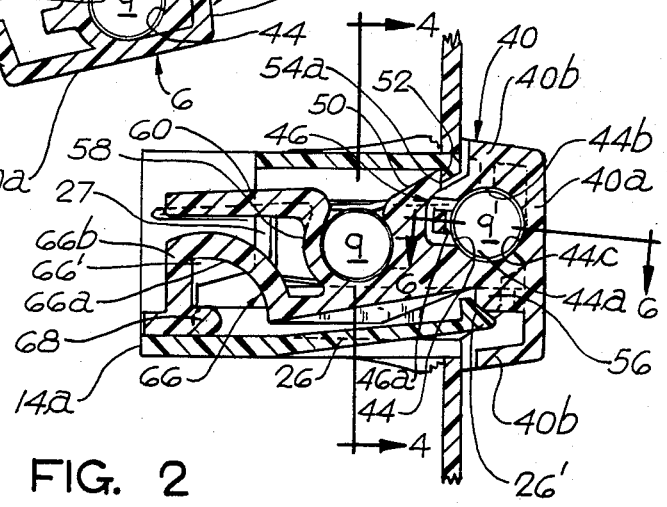
FIG. 2 is a center vertical longitudinal sectional view through the fuse holder shown in FIG. 1 when it is mounted within an opening in a vertical panel.

As best shown in FIG. 2, the fuse carrier 6 has a handle 40 which, when the fuse carrier is fully inserted within the fuse holder body 4, presents a forwardly extending horizontally extending vertical wall 40*a* terminating in forwardly extending top and bottom walls 40*b*—40*b* located immediately in front of and the forward margin of the fuse holder body. The top wall 40*b* is exposed between the walls 10—10 so as to be depressible to release the fuse carrier from a locked position within the fuse holder body 4 in a manner to be explained. The size of the handle 40 is such as to slightly overlap the margins of the fuse carrier-receiving opening at the front of the fuse holder body. Extending from the handle 40 is a relatively narrow rearwardly projecting shank 42 (FIG. 3). There is defined between the confronting surfaces of the handle 40 and shank 42 a horizontal, open-ended, spare fuse-carrying cavity 44 having its axis parallel to the front wall 40*a* of the handle. The cavity 44 is thus defined by a forwardly facing cylindrical segmental surfaces 44*b* at the forward end of the shank 42, and a segmental cylindrical surface 44*c* defined by the rear face of the front wall 40*a* of the handle 40. The cavity 44 has a size slidably to receive one of the end caps of the cylindrical fuse moved longitudinally into one of the upper ends of the cavity 44. The spare fuse 9' is held within the cavity 44 by a pair of oppositely projecting horizontal resilient arms 46–47 having enlarged ends 46*a*–47*a* which press against the glass housing of the cylindrical fuse between the end caps thereof. The arms 46–47 have an extent where they snap fit between the end caps of the spare fuse 9'.

The front end portion 42*a* of the carrier shank 42 has an upwardly and forwardly inclining surface 50 which terminates in an abrupt downwardly extending shoulder 52 which is urged by the locking tongue 26 forwardly in the fully inserted position of the carrier against the rearwardly facing shoulder 54*a* provided by a downwardly extending lip 54 of the center portion 12*a* of the top wall 12 of the fuse holder body. To this end, the tongue 26 has an enlarged head portion 26' (FIG. 2) which has a rearwardly and upwardly inclining forward face 26*a*' which presses upwardly against the rear corner portion of a depending rib 56 at the bottom of the carrier shank portion 42*a* (FIG. 3).

Figure 1:
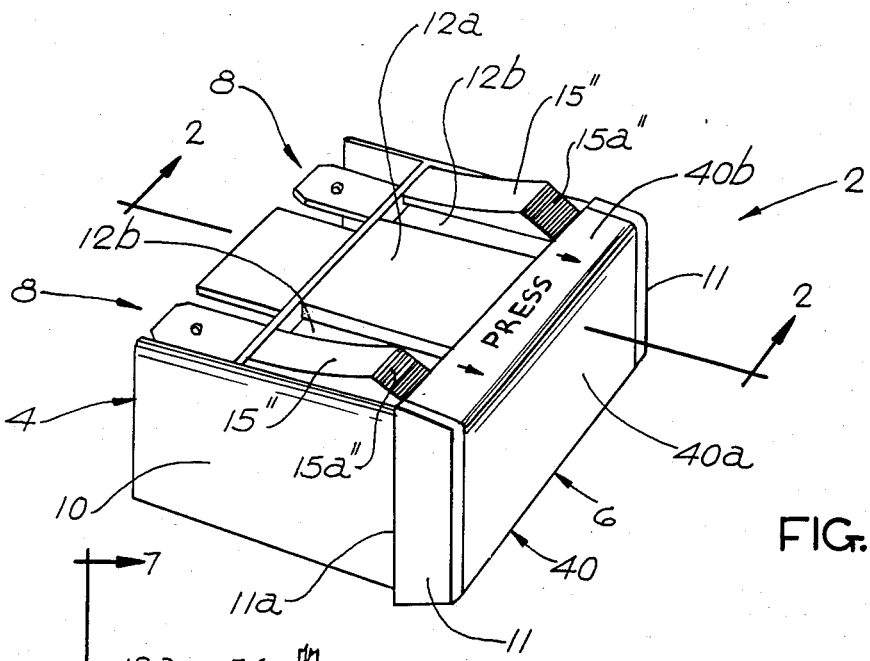
FIG. 1 is a perspective view of the fuse holder of the present invention before it is mounted in the opening of a panel, and when the fuse carrier thereof is in its fully inserted position within the fuse holder body.

When the fuse carrier 6 is moved into its fully retracted position as shown in FIG. 1, initially the upwardly and forwardly inclined top surface 50 of the fuse carrier shank engages with the correspondingly tapered front face 54*b* of the fuse holder body lip 54 to depress the normally upwardly inclined locking tongue 26.

The normally upper face of the carrier shank portion 42*a* is provided with a U-shaped upwardly opening, horizontal recess 57 (FIG. 3) for receiving the active fuse 9. The fuse ends project well beyond the recess 57. This recess 57 has an expandable entry mouth 57*a* longitudinally opening onto the top of the fuse carrier shank. The entry mouth 57*a* is of a much smaller size and diameter than that of the fuse 9. The recess 57 is of a generally cylindrical shape and of a size just slightly greater than the diameter of the glass portion of the fuse 9, so that the fuse 9 is loosely held within the recess 57, although it is prevented from being readily removed therefrom by the narrow mouth 57*a*. The rear defining wall 58 of this recess joins at the top thereof a rearwardly extending flexible finger portion 60 which, upon downward flexure thereof, enlarges the mouth 57*a* of the recess 57 to permit the passage of the fuse 9 into the recess 57. The outer defining wall 58 of the recess 57 also joins a rearwardly extending portion 66 of the carrier shank which includes a narrow curved portion 66*a* presenting a clearance space 66' and terminates in a downwardly extending end portion 66*b*. A pair of pivot pins 68—68 project horizontally outwardly from the sides of the rear shank portion 66*b*.

Referring now to FIG. 4, the rearwardly extending finger portion 60 of the carrier shank 42 is sized to be slidably fittable within the upper body carrier guideway 20. The carrier pivot pins 68—68 are sized to be slidably guided within the lower body carrier guideway 22. To permit the pin 68—68 to be initially inserted within the guideway 22, the locking tongue 26 is depressed to expose the front opening of the guideway 22. The head portion 26' of the locking tongue 26 provides a rearwardly facing shoulder 26*b* against which the pins 68—68 bear when the carrier is pulled to its fully extended position, as shown in FIG. 3 where the pivot pins 68—68 pivot against the locking tongue shoulder 26*b*' into its position where it hangs from the fuse carrier body 4. The clearance space 66' at the rear of the carrier shank permits this pivoting action to clear the head portion 26' of the locking tongue. In this position of the carrier, the end caps of the active fuse 9 can be readily grasped to pull the fuse from the recess 57 through the mouth 57*a* thereof. Also, the end caps of the spare fuse 9' are accessible for engagement behind the front wall 40*a* of the handle 6 of the carrier so that the space fuse can be withdrawn from the open-ended cavity 44.

A summary of the advantages of the fuse holder construction described is as follows.

The size of the opening of the fuse-receiving passageway 16 at the front of the fuse holder body 4 is so small that the user cannot insert his or her fingers within the opening to contact the terminal clips 8—8 deep within the fuse-receiving passageway 16, and thus the design of the fuse is a "shock safe" design. Also, as previously explained, the fuse holder body 4 is designed to receive a rear connector which fits within the rear opening of the fuse holder body 4 and is otherwise designed so that the wire harness and the connector together with the fuse holder body can be inserted through the panel opening 3*a* from the front thereof. The retaining force of the locking tongue 26 provides a vibration-free retention of the carrier within the fuse holder body and the carrier is simply released from its locked position within the fuse holder body by pressing down on the top wall 40*a* of the handle 6 of the carrier and then pulling the same forwardly into the position shown in FIG. 3. There the pivot pins 68—68 engage with the shoulder 26*b'* of the locking tongue 26 which prevents the carrier from sliding out of the fuse holder body, and the weight of the carrier causes it to pivot down into a position which exposes the active fuse 9 and spare fuse 9' for easy removal from the carrier. The user then has both hands available for changing fuses. Also the fuse carrier is not readily misplaced as in the case of conventional fuse carriers which must be completely separated from the fuse holder body to change fuses. These and the other described features (including the floating support for the active fuse, and the manner in which the fuse carrier is guided into and out of the fuse holder body, and the few number of parts making up the entire fuse holder assembly) facilitate the economical and convenient manufacture and use thereof and ensures a low resistance connection between the fuse end caps and the terminal clips.

It should be understood that numerous modifications may be made in the most preferred form of the invention described and shown in the drawings without deviating from the broader aspects of the invention.

I claim:

1. In a fuse holder comprising a main fuse holder body adapted to be mounted within an opening in a vertical panel and having a forwardly facing fuse and fuse carrier-receiving opening communicating with at least one passageway therein having a pair of fuse terminal-receiving clips aligned parallel to and located directly behind said fuse and fuse carrier-receiving opening, and a fuse carrier body insertable together with a fuse carried thereby into said passageway through said fuse and fuse carrier-receiving opening, the carrier having fuse receiving and retaining means for releasably holding an active fuse with spaced exposed terminals aligned parallel to said opening and positioned to engage with said fuse terminal-receiving clips when the carrier body is fully inserted within the fuse holder body, and said fuse holder body and fuse carrier body including complimentary guiding means for guiding said fuse carrier body for horizontal reciprocating movement within and into and out of said fuse holder body passageway through said fuse and fuse carrier-receiving opening while said fuse holder body is mounted in said panel opening, the improvement wherein said fuse holder body includes means in said fuse holder body passageway adjacent the front end thereof for preventing the complete separation of said fuse carrier body from said fuse holder body passageway when the fuse carrier body is pulled to the front of the fuse holder body, said fuse carrier body having pivot-forming means horizontally movable in the fuse holder body passageway with the rest of said carrier and pivotally engaging with the fuse holder body when said fuse carrier body is pulled into its forwardmost position where the carrier body can be pivoted into a position where it hangs downwardly from said fuse holder body while said pivot-forming means on the carrier body remains on said fuse holder body, said fuse-receiving and retaining means being then exposed to enable said active fuse to be removed from said fuse carrier and replaced by another fuse.

2. The fuse holder of claim 1 wherein said fuse carrier body drops automatically by force of gravity into said hanging position when said carrier body is released upon withdrawal thereof from the fuse holder body.

3. The fuse holder of claim 1 wherein the fuse holder body and fuse carrier body having releasable interlocking means which become engaged when the fuse carrier has been pushed into a fully retracted position within the fuse holder body.

4. The fuse holder of claim 3 wherein said fuse carrier body having a gripping handle at the front end thereof which is still exposed when the fuse carrier is fully inserted within the fuse holder body, said releasable interlocking means releasing said fuse carrier to permit partial withdrawal of the fuse carrier from the fuse holder body when a force is applied to said handle in a direction parallel to said fuse holder body opening.

5. The fuse holder of claim 4 wherein said interlocking means includes depending lip means at the top of said fuse holder body opening which lip means forms a rearwardly facing shoulder means, the fuse carrier having at the top thereof upward projecting means forming forwardly facing shoulder means adapted to abut said rearwardly facing shoulder means, and depressible resilient locking tongue means in the bottom of said fuse holder body which tongue means is engaged and depressed by a bottom portion of said fuse carrier as it is moved into a fully retracted position within said fuse holder body, the locking tongue means providing an upwardly and forwardly directed force against said fuse carrier body which urges said forwardly facing shoulder means of the fuse carrier against the rearwardly facing shoulder means of said fuse holder body when the fuse carrier is in its fully inserted position within the fuse holder body, depression of said handle releasing said carrier body from interlocking engagement with said fuse holder body at said shoulder means so that the fuse carrier body can be withdrawn from said fuse holder body.

6. The fuse holder of claim 1 wherein said fuse receiving and retaining means in said fuse carrier body comprises a generally U-shaped recess extending parallel to said fuse holder opening and longitudinally opening onto the upper face of said carrier through a mouth of a lesser size than the size of the fuse to be carried by the recess, at least one of the defining walls of said recess being flexible so that when the fuse is pushed into said mouth it expands to permit passage of the fuse into said recess, said recess retaining said fuse loosely therein permitting the fuse to seek its most effective position of engagement with the fuse terminal-receiving clips of the fuse holder body when the fuse holder is fully inserted therein.

7. The fuse holder of claim 6 wherein said fuse carrier body is provided with a spare fuse-receiving cavity extending parallel to said recess and adapted releasably to receive a spare fuse inserted therein oriented parallel to the active fuse supported in said recess.

8. The fuse holder of claim 1 wherein said pivot-forming means includes laterally extending pivot pin means at the rear of said carrier body, said fuse holder body having rearwardly facing shoulder means at the bottom front end thereof engaged by said pivot pin means when the fuse carrier body is pulled to a fully forward position within said fuse holder body.

9. The fuse holder of claim 8 wherein said guiding means includes a guideway in said fuse holder body for guiding said laterally extending pivot means of said carrier body within said fuse holder body.

10. The fuse holder of claim 5 wherein said pivot-forming means includes laterally extending pivot pin means at the rear of said carrier body, said pivot pin means pivotally engaging a rearwardly facing shoulder means formed at the end of said locking tongue when the fuse carrier body is pulled to a fully forward position within said fuse holder body.

11. The fuse holder of claim 6 wherein the rear defining wall of said U-shaped recess in said carrier body is said flexible defining wall.

12. The fuse holder of claim 11 wherein said fuse carrier body is provided with a spare fuse-receiving cavity extending parallel to said recess and adapted releasably to receive a spare fuse inserted therein oriented parallel to the active fuse supported in said recess.

13. The fuse holder of claim 6 wherein said carrier body has a handle portion from which rearwardly extends a shank portion, said U-shaped recess being in the upper face of said shank portion, and the rear defining wall of said recess terminating in a rearwardly extending portion which deflects said outer defining wall to enlarge the mouth of said recess.

14. The fuse holder of claim 13 wherein said rear defining wall of said recess joins at the bottom of the shank portion of said fuse carrier body a portion including said pivot-forming means.

15. The fuse holder of claim 14 wherein said fuse holder body having a first guideway therein which slidably receives said shank portion of said fuse carrier for guiding said fuse carrier into and out of said fuse holder body.

16. The fuse holder of claim 13 wherein said fuse holder body has a guideway-forming means for slidably receiving said pivot-forming means for guiding said fuse carrier body into and out of said fuse holder body.

17. The fuse holder of claim 5 wherein said fuse receiving and retaining means in said fuse carrier body comprises an active fuse-receiving recess extending parallel to said fuse holder opening, the fuse carrier body also being provided with a spare fuse-receiving means extending parallel to said recess and adapted releasably to receive a spare fuse inserted therein oriented parallel to the active fuse supported in said recess.

18. The fuse holder of claim 17 wherein said fuse carrier body comprises a handle portion which remains exposed on the outside of said fuse holder body when the fuse carrier body is fully inserted within the fuse holder body, the fuse carrier body having a rearwardly extending shank portion which contains said recess positioned intermediate the ends thereof, and said spare fuse-receiving means is located forwardly of said active fuse-receiving recess.

19. The fuse holder of claim 17 wherein said spare fuse-receiving means is an open-ended cavity defined between confronting surfaces at the front of said shank portion and the rear of said handle portion of said fuse carrier body.

20. In a fuse holder comprising a main fuse holder body adapted to be mounted within an opening in a vertical panel and having a forwardly facing fuse carrier-receiving opening communicating with a passageway therein having a pair of fuse terminal-receiving clips aligned parallel to said opening, and a fuse carrier insertable into said passageway through said opening, the carrier having fuses receiving and retaining means for releasably holding an active fuse with spaced exposed terminals aligned parallel to said opening and positioned to engage with said fuse terminal-receiving clips when the carrier is fully inserted within the fuse holder body, said fuse holder body and fuse carrier including complimentary guiding means for guiding said fuse carrier for movement into and out of said fuse holder body through said opening, the improvement wherein the fuse holder body and fuse carrier have releasable interlocking means which become engaged when the fuse carrier has been pushed into a fully retracted position within the fuse holder body, said fuse carrier has a handle at the front end thereof which is still exposed when the fuse carrier is fully inserted within the fuse holder body, said releasable interlocking means releasing said fuse carrier to permit withdrawal of the fuse carrier from the fuse holder body when a force is applied to said handle in a direction parallel to said fuse holder body opening, said interlocking means includes depending lip means at the top of said fuse holder body opening which lip means forms rearwardly facing shoulder means, the fuse carrier having at the top thereof upward projecting means forming forwardly facing shoulder means adapted to abut said rearwardly facing shoulder means, and depressible resilient locking tongue means in the bottom of said fuse holder body which tongue means is engaged and depressed by a bottom portion of said fuse carrier as it is moved into a fully retracted position within said fuse holder body, the locking tongue means providing an upwardly and forwardly directed force against said fuse carrier which urges said forwardly facing shoulder means of the fuse carrier against the rearwardly facing shoulder means of said fuse holder body when the fuse carrier is in its fully inserted position within the fuse holder body, depression of said handle releasing said carrier from interlocking engagement with said fuse holder body at said shoulder means so that the fuse carrier can be withdrawn from said fuse holder body.

* * * * *